United States Patent [19]

Shaffer et al.

[11] Patent Number: 4,841,648

[45] Date of Patent: Jun. 27, 1989

[54] PERSONALIZED INSOLE KIT

[76] Inventors: David E. Shaffer, 386 Spruce La., East Meadow, N.Y. 11554; Michael P. Della Corte, 283 Carnation Ave., Floral Park, N.Y. 11001

[21] Appl. No.: 161,954

[22] Filed: Feb. 29, 1988

[51] Int. Cl.[4] ..... A43B 13/38; A61F 5/14

[52] U.S. Cl. ..... 36/43; 36/44; 36/91; 128/586; 128/603; 128/615; 434/260; 434/170

[58] Field of Search ..... 36/43, 44, 91, 100, 36/101; 2/DIG. 6; 128/581, 586, 603, 614, 615, 617; 434/84, 170, 207, 260, 397

[56] References Cited

U.S. PATENT DOCUMENTS

| | | | |
|---|---|---|---|
| 2,421,088 | 5/1947 | Sims | 128/615 |
| 2,569,721 | 10/1951 | Juers | 128/586 |
| 2,964,858 | 12/1960 | Rutherford | 434/170 |
| 3,084,695 | 4/1963 | O'Donnell | 128/615 |
| 4,079,526 | 3/1978 | Fukuoka | 36/44 X |
| 4,316,333 | 2/1982 | Rothschild | 36/91 X |
| 4,603,698 | 8/1986 | Cherniak | 36/43 X |
| 4,643,683 | 2/1987 | Orsini et al. | 434/170 |
| 4,694,831 | 9/1987 | Seltzer | 36/43 X |
| 4,710,979 | 12/1987 | Bull | 434/260 X |

*Primary Examiner*—James Kee Chi

*Attorney, Agent, or Firm*—Michael I. Kroll

[57] ABSTRACT

A personalized insole self made by a patient for relief of foot discomfort and which includes a plurality of corrective components each having a shape formed for a specific correction, an insole which has a surface that contains a plurality of shapes, each disposed for a specific correction and each shape of the plurality of shapes that are contained on the surface of the insole are substantially equivalent to a respective shape of a corrective component of the plurality of corrective components, hooks and loops for affixing the plurality of corrective components to the surface of the insole so as to allow the patient to modify the insole by affixing a corrective component for the specific correction of the plurality of corrective components to a substantially equivalent shape of the plurality of shapes that are contained on the surface of the insole so that a personalized insole can be self made by the patient for the relief of foot discomfort.

26 Claims, 1 Drawing Sheet

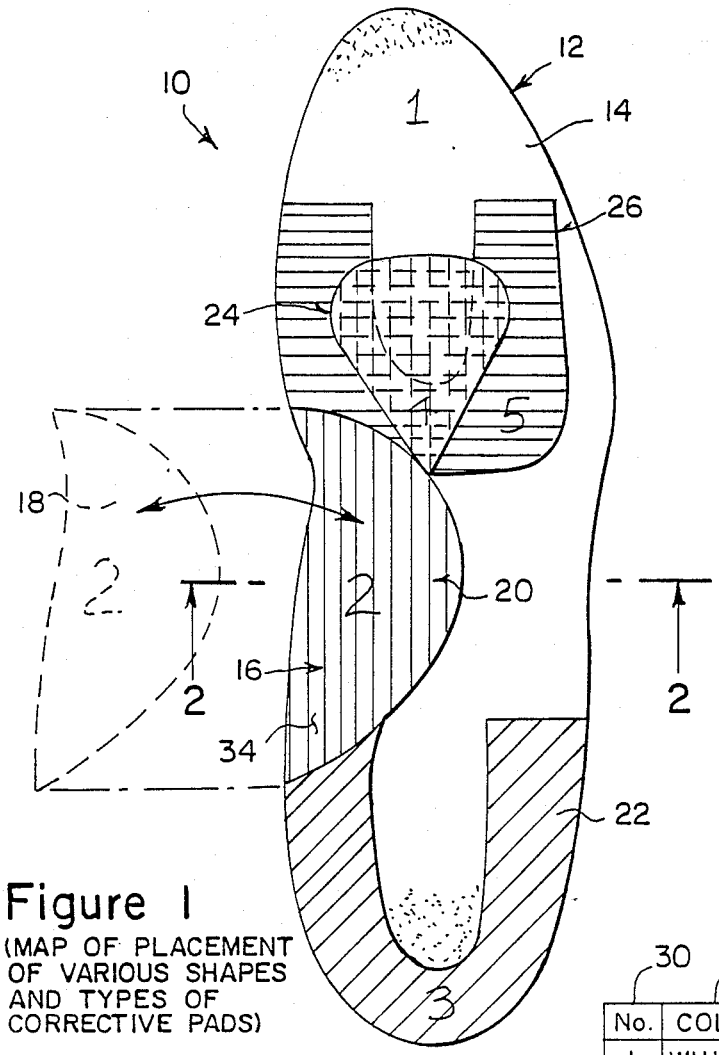
Figure 1
(MAP OF PLACEMENT OF VARIOUS SHAPES AND TYPES OF CORRECTIVE PADS)
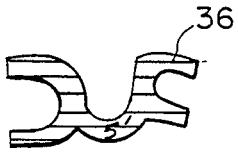
Figure 3
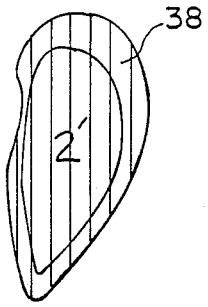
Figure 4
| No. | COLOR | TYPE OF CORRECTIVE PAD |
|---|---|---|
| 1 | WHITE | BASIC STARTER MAP |
| 2 | RED | ARCH PAIN |
| 3 | BROWN | HEEL PAIN |
| 4 | YELLOW | METATARSAL PAIN |
| 5 | BLUE | CORN/CALLUS/LESION |
Figure 2
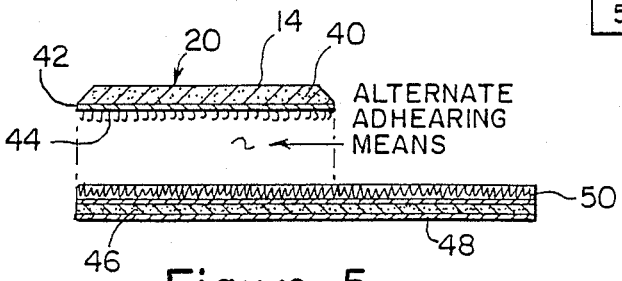
Figure 5
(VELCRO OR OTHER ALTERNATE FASTENING MEANS)

PERSONALIZED INSOLE KIT

BACKGROUND OF THE INVENTION

1. Field of the Invention

The present invention relates to an orthotic device. More particularly, the present invention relates to an orthotic device which has at least one corrective component with a shape formed for a specific correction.

2. Description of the Prior Art

Orthotic devices of the above mentioned general type are known in the art. One such orthotic device is disclosed, for example, in a kit containing an insole and a plurality of self-adhering corrective components. The modifying of the insole with the plurality of corrective components must be done by an orthotic professional. Since the insole is not coded either by shape, color, or number to direct the patient in the correct placement of the plurality of corrective components on the insole for respective corrections, the modifying of the insole with the plurality of corrective components cannot be accomplished by the patient.

Another such orthotic device is disclosed, for example, in a heel cup worn inside the shoe. This orthotic device merely cushions and absorbs stress only on the heel created by walking and jogging and provides no orthotic corrections.

Another such orthotic device is disclosed, for example, in a ready made insole premolded to a patient's specific foot contour. This orthotic device is for patients with only simple and specific foot function problems. If the simple and specific foot function problems change, so must the device, since the device can not be modified by the patient.

Another such orthotic device is disclosed, for example, in a heel pad made up of a durable base and a soft cover. A section of material is strategically removed from the base to eliminate pressure on a heel spur or a contusion. This orthotic device merely cushions and eliminates pain only on the heel created by heel spurs or contusions and provides no orthotic corrections.

The boom in jogging and running, that has characterized the fitness movement, has increased the demand for orthotic devices. The prior art orthotic devices, supra, are expensive, apply only to specific corrections if corrections are provided, require the services of a professional to construct and fit, and cannot be personalized by the patient.

SUMMARY OF THE INVENTION

Accordingly, it is an object of the present invention to provide a personalized insole kit which avoids the disadvantages of the prior art.

More particularly, it is an object of the present invention to provide a personalized insole kit which can be self made by the patient, offers an easy and affordable way of relieving foot discomfort of a patient, is coded to allow the patient to customize the insole for specific corrections, is inexpensive, and is adjustable.

In keeping with these objects, and with others which will become apparent hereinafter, one feature of the present invention resides, briefly stated, in a personalized insole self made by a patient for relief of foot discomfort and which includes a plurality of corrective components each having a shape formed for a specific correction, an insole, and means for affixing the plurality of corrective components to the surface of the insole so as to allow the patient to modify the insole by affixing a corrective component for the specific correction of the plurality of corrective components to the surface of the insole wherein the insole has a surface containing a plurality of shapes each disposed for the specific correction and each shape of the plurality of shapes contained on the surface of the insole are substantially equivalent to a respective shape of a corrective component of the plurality of corrective components.

When the personalized insole kit is designed in accordance with the present invention, a personalized insole can be self made by the patient for the relief of foot discomfort.

In accordance with another feature of the present invention, the insole and each corrective component of the plurality of corrective components is a resilient material, but is not limited to it.

Another feature of the present invention is that the insole and each corrective component of the plurality of corrective components is a foam pad.

Yet another feature of the present invention is that the plurality of corrective components is six.

Still another feature of the present invention is that a first corrective component of the six corrective components is an arch pad.

Yet still another feature of the present invention is that a second corrective component of the six corrective components is a heel pad.

Still yet another feature of the present invention is that a third corrective component of the six corrective components is a matatarsal pad.

Another feature of the present invention is that a fourth corrective component of the six corrective components is a corn/callus/lesion pad.

Yet another feature of the present invention is that a fifth corrective component of the six corrective components is an auxiliary arch pad.

Still another feature of the present invention is that a sixth corrective component of the six corrective components is a metatarsal dispersion pad.

Yet still another feature of the present invention is that each corrective component of the plurality of corrective components is color coded to the substantially equivalent shape of the plurality of shapes disposed on the surface of the insole.

Still yet another feature of the present invention is that a first corrective component of the six corrective components is colored red.

Another feature of the present invention is that a second corrective component of the six corrective components is colored brown.

Yet another feature of the present invention is that a third corrective component of the six corrective components is colored yellow.

Still another feature of the present invention is that a fourth corrective component of the six corrective components is colored blue.

Yet still another feature of the present invention is that a fifth corrective component of the six corrective components is colored red.

Still yet another feature of the present invention is that a sixth corrective component of the six corrective components is colored blue.

Another feature of the present invention is that each corrective component of the plurality of corrective components is numerically coded to the substantially equivalent shape of the plurality of shapes disposed on the surface of the insole.

Yet another feature of the present invention is that a first corrective component of the six corrective components is numbered two.

Still another feature of the present invention is that a second corrective component of the six corrective components is numbered three.

Yet still another feature of the present invention is that a third corrective component of the six corrective components is numbered four.

Still yet another feature of the present invention is that a fourth corrective component of the six corrective components is numbered five.

Another feature of the present invention is that a fifth corrective component of the six corrective components is numbered two prime.

Yet another feature of the present invention is that a sixth corrective component of the six corrective components is numbered five prime.

Still another feature of the present invention is that the affixing means include hooks and loops.

Finally, still a further feature of the present invention is that it further comprises a code chart.

The novel features which are considered characteristic for the invention are set forth in particular in the appended claims. The invention itself, however, both as to its construction and its method of operation, together with additional objects and advantages thereof, will be best understood from the following description of the specific embodiment when read in connection with the accompanying drawing.

BRIEF DESCRIPTION OF THE DRAWING

FIG. 1 is a plan view of the present invention showing four of the corrective components affixed to the designated areas on the surface of the insole;

FIG. 2 depicts the code chart which assists the patient in positioning the proper corrective components on the surface of the insole, as shown in FIG. 1, to accomplish specific corrections;

FIG. 3 is a plan view of a first corrective component that is positionable on top of a corrective component shown in FIG. 1;

FIG. 4 is a plan view of a second corrective component that is positionable on top of another corrective component shown in FIG. 1; and, FIG. 5 is a cross section taken along line 2—2 of FIG. 1 and shows how the plurality of corrective components are affixed to the surface of the insole of FIG. 1.

LIST OF REFERENCE NUMERALS

10 personalized insole kit
12 insole pad
14 surface
16 plurality of strategically disposed shapes
18 plurality of corrective components
20 arch pad
22 heel pad
24 metatarsal pad
26 corn/callus/lesion pad
28 code chart
30 number code column
32 color code column
34 correction diagnosis column
36 metatarsal dispersion pad
38 auxiliary arch pad
40 resilient material, but is not limited to it
42 backing
44 hook part
46 resilient material, but is not limited to it
48 backing
50 loop part

DETAILED DESCRIPTION OF THE PREFERRED EMBODIMENT

Referring now to FIG. 1, the personalized insole kit of the present invention is shown generally at 10. The personalized insole kit 10 includes an insole pad 12 which has a surface 14 that contains a plurality of strategically disposed two-dimensional shapes 16. The personalized insole kit 10 also includes a plurality of corrective components 18.

The plurality of shapes 16 strategically disposed on the surface 14 of the insole 12 provide a unique "mapping system", as shown in FIG. 1, that allows a patient to properly position the plurality of corrective components 18 for specific corrections and produce a self made orthotic device.

As shown in FIG. 1, the plurality of corrective components 18 include an arch pad 20, a heel pad 22, a metatarsal pad 24, and a corn/callus/lesion pad 26. The plurality of corrective components 18 are coded to the plurality of shapes 16 that are strategically disposed on the surface 14 of the insole 12. This coding assists the patient in properly positioning the plurality of corrective components 18 for specific corrections. Either a color code or a number code or both can be used.

As shown in FIG. 1, the arch pad 20 is colored red and contains the number two. The heel pad 22 is colored brown and contains the number three. The metatarsal pad 24 is colored yellow and contains the number four. The corn/callus/lesion pad 26 is colored blue and contains the number five.

As shown in FIG. 1, the strategically disposed shape on the surface 14 of the insole 12, for the proper position of the arch pad 20, is colored red and contains the number two. The strategically disposed shape on the surface 14 of the insole 12, for the proper position of the heel pad 22, is colored brown and contains the number three. The strategically disposed shape on the surface 14 of the insole 12, for the proper position of the metatersal pad 24, is colored yellow and contains the number four. The strategically disposed shape on the surface 14 of the insole 12, for the proper position of the corn/callus/lesion pad 26, is colored blue and contains the number five.

To further assist the patient in properly positioning the plurality of corrective components 18 for specific corrections, a code chart 28, shown in FIG. 2, is provided. The code chart 28 includes a number code column 30, a color code column 32, and a correction diagnosis column 34. To utilize the code chart 28, the patient first looks down the correction diagnosis column 34 and locates the specific disorder. After the specific disorder has been located in the correction diagnosis column 34, the patient is then able to identify the specific number code and color code for the required correction component. Since the plurality of shapes 16 that are strategically disposed on the surface 14 of the insole pad 12 are coded to the plurality of corrective components 18, the patient, once the required corrective component is identified from the code chart 28, will know exactly where to place the required corrective component.

Two additional corrective components are provided in the personalized insole kit 10. These two additional corrective components are positioned on top of other already positioned corrective components. The two additional corrective components include a metatarsal dispersion pad 36 as shown in FIG. 3, and an auxiliary arch pad 38, as shown in FIG. 4.

The metatarsal dispersion pad 36, if used, is positioned on top of the corn/callus/lesion pad 26. In order to assist the patient in the proper positioning of the metatarsal dispersion pad 36, the metatarsal dispersion pad 36 is coded with either a color or a number or both. Since the metatarsal dispersion pad 36 is positioned on top of the corn/callus/lesion pad 26, it is colored blue and contains the number five prime.

The auxiliary arch pad 38, if used, is positioned on top of the arch pad 20. In order to assist the patient in the proper positioning of the auxiliary arch pad 38, the auxiliary arch pad 38 is coded with either a color or a number or both. Since the auxiliary arch pad 36 is positioned on top of the arch pad 20, it is colored red and contains the number two prime.

As shown in FIG. 5, the arch pad 20, like the heel pad 22, the metatarsal pad 24, the corn/callus/lesion pad 26, the metatarsal dispersion pad 36, and the auxiliary arch pad 38 are made of a resilient material, but is not limited to it 40 mounted on a backing 42 which contains a hook part 44 of a hook and loop connector. The resilient material, but is not limited to it 40 may be foam padding but is not limited to it. The insole pad 12 is made of a resilient material, but is not limited to it 46 mounted on a backing 48. The resilient material, but is not limited to it 46 may be foam padding but is not limited to it. The surface 14 of the insole 12 contains a loop part 50 of a hook and loop connector. The hook part 44 on the plurality of corrective components 18 and the loop part 50 on the insole 12 allow the plurality of corrective components to be removably mounted to the insole 12. Other alternate adhering means may be used to fasten the plurality of corrective components 18 to the insole 12.

The personalized insole kit 10 of the present invention teaches the use of a basic shoe insert insole 12 with a unique "mapping system" on the surface 14 of the insole 12. The "mapping system" includes either a color code or a number code or a label for the specific type of foot discomfort. The plurality of corrective components 18 can be placed in specific areas of pain, as indicated by the "mapping system" on the surface 14 of the insole 12.

By using the "mapping system", the patient can easily, affordably, and immediately relieve foot discomfort since the "mapping system" shows the required corrections. Additional corrections can be easily added when basic corrections are ineffective or inadequate.

The personalized insole kit 10 of the present invention allows the patient who cannot tolerate prescription orthotics or afford them to construct a required orthotic device by merely adjusting the insole 12 with the plurality of corrective components 18, according to the individual needs.

It will be understood that each of the elements described above, or two or more together, may also find a useful application in other types of constructions differing from the type described above.

While the invention has been illustrated and described as embodied in a personalized insole kit it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A personalized removable insole self made from simple construction by a patient for relief of foot discomfort, comprising:

(a) a plurality of removable and replaceable corrective components each having a shape formed for a specific correction so that the patient's money is saved because only said plurality of corrective components would need replacement;

(b) a removable insole having a surface containing a plurality of two-dimensional shapes forming a map in which each shape of said plurality of two-dimensional shapes being disposed for said specific correction, each shape of said plurality of two-dimensional shapes contained on said surface of said insole being substantially equivalent to a respective shape of a corrective component of said plurality of corrective components;

(c) means for self adhering said plurality of corrective components in a simple fashion to said surface of said insole so as to allow the patient to modify said insole by self adhering a corrective component for said specific correction of said plurality of corrective components to a substantially equivalent shape of said plurality of two-dimensional shapes contained on said surface of said insole so that a personalized removable insole can be self made from simple construction by the patient for the relief of foot discomfort.

2. An insole as defined in claim 1, wherein said insole and said each corrective component of said plurality of corrective components is a resilient material.

3. An insole as defined in claim 2, wherein said insole and said each corrective component of said plurality of corrective components is a foam pad.

4. An insole as defined in claim 1, wherein said plurality of corrective components is six.

5. An insole as defined in claim 4, wherein a first corrective component of said six corrective components is an arch pad.

6. An insole as defined in claim 4, wherein a second corrective component of said six corrective components is a heel pad.

7. An insole as defined in claim 4, wherein a third corrective component of said six corrective components is a metatarsal pad.

8. An insole as defined in claim 4, wherein a fourth corrective component of said six corrective components is a corn and callus and lesion pad.

9. An insole as defined in claim 4, wherein a fifth corrective component of said six corrective components is an auxiliary arch pad.

10. An insole as defined in claim 4, wherein a sixth corrective component of said six corrective components is a metatarsal dispersion pad.

11. An insole as defined in claim 4, wherein said each corrective component of said plurality of corrective components is color coded to said substantially equivalent shape of said plurality of shapes disposed on said surface of said insole.

12. An insole as defined in claim 11, wherein a first corrective component of said six corrective components is colored red.

13. An insole as defined in claim 11, wherein a second corrective component of said six corrective components is colored brown.

14. An insole as defined in claim 11, wherein a third corrective component of said six corrective components is colored yellow.

15. An insole as defined in claim 11, wherein a fourth corrective component of said six corrective components is colored blue.

16. An insole as defined in claim 11, wherein a fifth corrective component of said six corrective components is colored red.

17. An insole as defined in claim 11, wherein a sixth corrective component of said six corrective components is colored blue.

18. An insole as defined in claim 4, wherein said each corrective component of said plurality of corrective components is numerically coded to said substantially equivalent shape of said plurality of shapes disposed on said surface of said insole.

19. An insole as defined in claim 18, wherein a first corrective component of said six corrective components is numbered two.

20. An insole as defined in claim 18, wherein a second corrective component of said six corrective components is numbered three.

21. An insole as defined in claim 18, wherein a third corrective component of said six corrective components is numbered four.

22. An insole as defined in claim 18, wherein a fourth corrective component of said six corrective components is numbered five.

23. An insole as defined in claim 18, wherein a fifth corrective component of said six corrective components is numbered two prime.

24. An insole as defined in claim 18, wherein a sixth corrective component of said six corrective components is numbered five prime.

25. An insole as defined in claim 1, wherein said affixing means include hooks and loops.

26. An insole as defined in claim 1; further comprising a code chart separate from the insole and for further assisting the patient in properly positioning said plurality of corrective components.

* * * * *